US006698641B2

(12) United States Patent
Flannery et al.

(10) Patent No.: US 6,698,641 B2
(45) Date of Patent: Mar. 2, 2004

(54) SYSTEM FOR DISPENSING PLASTIC FASTENERS

(75) Inventors: Steven E. Flannery, Wayland, MA (US); Paul A. Davignon, Uxbridge, MA (US); Hidekatsu Kinbara, Mizunami (JP)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/368,974

(22) Filed: Feb. 19, 2003

(65) Prior Publication Data

US 2003/0127489 A1 Jul. 10, 2003

Related U.S. Application Data

(62) Division of application No. 09/867,264, filed on May 29, 2001, now Pat. No. 6,561,405.

(51) Int. Cl.[7] ..... B25C 1/04
(52) U.S. Cl. ..... 227/67; 227/124
(58) Field of Search ..... 227/67, 71, 135, 227/136, 124

(56) References Cited

U.S. PATENT DOCUMENTS 5,433,366 A 7/1995 Deschenes et al.
5,472,130 A * 12/1995 Beringhause et al. ..... 227/67
5,501,002 A * 3/1996 Fukami ..... 227/67
5,615,816 A 4/1997 Deschenes et al.
5,678,746 A * 10/1997 Grendol ..... 227/71
5,878,935 A * 3/1999 Furutsu ..... 227/67
5,950,901 A * 9/1999 Kubota ..... 227/71
6,267,285 B1 * 7/2001 Raymond et al. ..... 227/67
6,561,406 B1 * 5/2003 Furutsu et al. ..... 227/67

* cited by examiner

*Primary Examiner*—Scott A. Smith
(74) *Attorney, Agent, or Firm*—Kriegsman & Kriegsman

(57) ABSTRACT

A system for dispensing a fastener from a reel of fastener stock so as to secure a product onto a display card includes a module for dispensing the fastener, a counterbalance for supporting the module, a mounting stand for supporting the counterbalance, a reel holder for supporting the reel of fastener stock and an anvil for supporting the product and display card. The module includes a hollowed needle, a retractable needle guard assembly disposed over the needle, a feed mechanism for advancing the fastener into the needle, a severing mechanism for severing the fastener from the fastener stock, and an ejection mechanism for ejecting the fastener through the needle. The retractable needle guard assembly is capable of being disposed between a protective position and a retracted position and includes a fixedly mounted needle guard and a movable needle guard which is slidably mounted on the fixedly mounted needle guard.

12 Claims, 12 Drawing Sheets

SYSTEM FOR DISPENSING PLASTIC FASTENERS

CROSS-REFERENCE TO RELATED APPLICATIONS

This application is a division USSN: 09/867,264 entitled SYSTEM FOR DISPENSING PLASTIC FASTENERS, filed on May 29, 2001, now U.S. Pat. No. 6,561,405, in the names of Steven E. Flannery, Paul A Davignon and Hidekatsu Kinbara.

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

Either manually or with the aid of specifically designed devices, individual fasteners may be dispensed from the ladder stock to couple buttons to fabric, merchandising tags to articles of commerce, or, in general, any two desired articles. In those instances where the dispensing device has dual needles, the attachments severed from the stock can be used like staples to secure objects and items.

Specifically designed devices for dispensing individual plastic fasteners are well known in the art. Plastic fastener dispensing devices are commonly used to sever individual plastic fasteners from continuously connected ladder stock and to attach the severed individual plastic fastener to items.

In commonly assigned U.S. Pat. No. 5,615,816, which is incorporated herein by reference, there is disclosed an apparatus for dispensing attachments from continuously connected ladder stock of the type comprising a pair of plastic side members coupled together by a plurality of plastic cross links. The apparatus includes a mount, a support movably mounted on the mount, and a pair of carrier blocks mounted on the support. A needle block is mounted on each carrier block and a hollow, slotted needle is mounted on each needle block. A feed mechanism including a pair of feed wheels, is mounted on the support for advancing the ladder stock into the hollow slotted needles and a pair feed tracks, one for each hollow slotted needle, are provided through which the ladder stock passes from the feed wheels into the pair of hollow slotted needles. A pair of knives are provided for severing an attachment from the ladder stock, and a pair of ejector rods are provided for ejecting the severed attachment through the hollow slotted needles. The carrier blocks are disposed parallel to each other and movable sideways relative to each other so that the spacing between the hollow slotted needles can be changed for different applications. The feed wheels are disposed parallel to each other and are capable of being moved sideways relative to each other so that their spacing can be changed to accommodate different widths of ladder stock. In order to provide a path for the ladder stock form the feed wheels to the hollow slotted needles for different feed wheel spacings and/or needle spacings, each feed track assembly includes a pivotally mounted section.

The apparatus disclosed in U.S. Pat. No. 5,615,816 is well known in the art and is commonly referred to in the art simply as a variable needle system (VNS).

Variable needle systems of the type described in U.S. Pat. No. 5,616,816 are commonly used in the art to secure a product for sale, such as a toy, hardware item or houseware item, onto a display card using one or more plastic fasteners. As can be appreciated, when used to secure a product for sale onto a display card, plastic fasteners are commonly referred to as elastic staples in the art.

It should be noted that the use of a variable needle system of the type described in U.S. Pat. No. 5,616,816 to secure a product of sale onto a display card using one or more elastic staples provides numerous advantages. Specifically, the capability of such a variable needle system to continuously dispense elastic staples from a roll of fastener stock increases the productivity in which an operator is able to secure products for sale onto associated display cards, which is highly desirable. Accordingly, variable needle systems of the type described in U.S. Pat. No. 5,616,816 are commonly used on assembly lines for packaging products.

It should also be noted that the use of elastic staples to secure a product of sale onto a display card provides numerous advantages.

As an example, the particular construction of an elastic staple creates aesthetic benefits which are highly desirable. Specifically, the use of elastic staples enables the product for sale to be mounted onto a display card, thereby enabling the product to be presented to the potential customer in an ideal packaging to see, feel and manipulate the product at the point of purchase. Furthermore, it has been found that the elastic staple is barely visible when securing a product for sale onto its associated display card.

As another example, the elasticity of the staple allows for the fastener to be used in a wide range of applications and in conjunction with a variety of differently sized products, which is highly desirable.

As another example, the elasticity of the staple allows for the fastener to conform tightly against the product for sale, thereby creating a strong and durable attachment of the product for sale onto its associated display card, which is highly desirable. As a result, the product remains securely fastened onto the display card until after purchase.

Although well known and widely used in the art for securing products for sale onto display cards, variable needle systems of the type disclosed in U.S. Pat. No. 5,615,816 suffer from a few notable drawbacks.

As a first drawback, the variable needle system disclosed in U.S. Pat. No. 5,615,816 is typically fixedly mounted onto a support structure. Accordingly, in use, the operator is required to manually urge the items to be coupled up against the pair of needles in such a manner so that the pair of needles penetrates through the items. As a consequence, it has been found that the user is at risk of inadvertently contacting the sharpened end of the needles, which is highly undesirable.

As a second drawback, the variable needle system disclosed in U.S. Pat. No. 5,615,816 is constructed so that the operator can insert the needles into and through the items to be coupled at variable depths. Specifically, the operator is unable to regulate the degree of insertion of the needles through the items. As a result, if the needles are inserted too far through the items, the fastener can become overstretched and, as a result, will break, which is highly undesirable. Furthermore, if the needles are not inserted far enough through the items, the fastener is unable to penetrate through the items, thereby precluding proper coupling, which is highly undesirable.

As a third drawback, the variable needle system disclosed in U.S. Pat. No. 5,615,816 fails to adequately support, or stiffen, the pair of needles. As a result, the needles are susceptible to bending and breaking when inserted through the items to be coupled together, which is highly undesirable.

SUMMARY OF THE INVENTION

It is an object of the present invention to provide a new and improved system for dispensing a plastic fastener from a reel of fastener stock to couple together two or more items.

It is another object of the present invention to provide a system as described above which includes at a pair of hollowed needles, each needle having a sharpened tip, wherein the pair of hollowed needles enable the plastic fastener to pass through the items to be coupled together.

It is yet another object of the present invention to provide a system as described above which protects the operator from inadvertently contacting the sharpened tip of the pair of needles.

It is still another object of the present invention to provide a system as described above which enables the operator to regulate the degree of insertion of the pair of needles through the items to be coupled together.

It is yet still another object of the present invention to provide a system as described above which adequately supports, or stiffens, the pair of needles.

It is yet a further object of the present invention to provide a system for dispensing a plastic fastener from a reel of fastener stock to couple together two or more items which has a limited number of parts, which is easy to use and which is inexpensive to manufacture.

Accordingly, as one feature of the present invention, there is provided a system for dispensing a plastic fastener from a reel of fastener stock to couple together two or more objects, said system comprising a module for dispensing the plastic fastener from the reel of fastener stock to couple together the two or more objects, and a counterbalance for supporting said module.

As another feature of the present invention, there is provided a module for dispensing a plastic fastener from a reel of fastener stock to couple together two or more objects, said module comprising a hollowed needle having a sharpened tip, a needle holder for holding said hollowed needle, a retractable needle guard assembly mounted onto said needle holder over said hollowed needle, a feed mechanism for advancing the fastener stock into said hollowed needle, a severing mechanism for severing the fastener to be dispensed through said hollowed needle from the fastener stock, and an ejection mechanism for ejecting the severed fastener through said hollowed needle.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
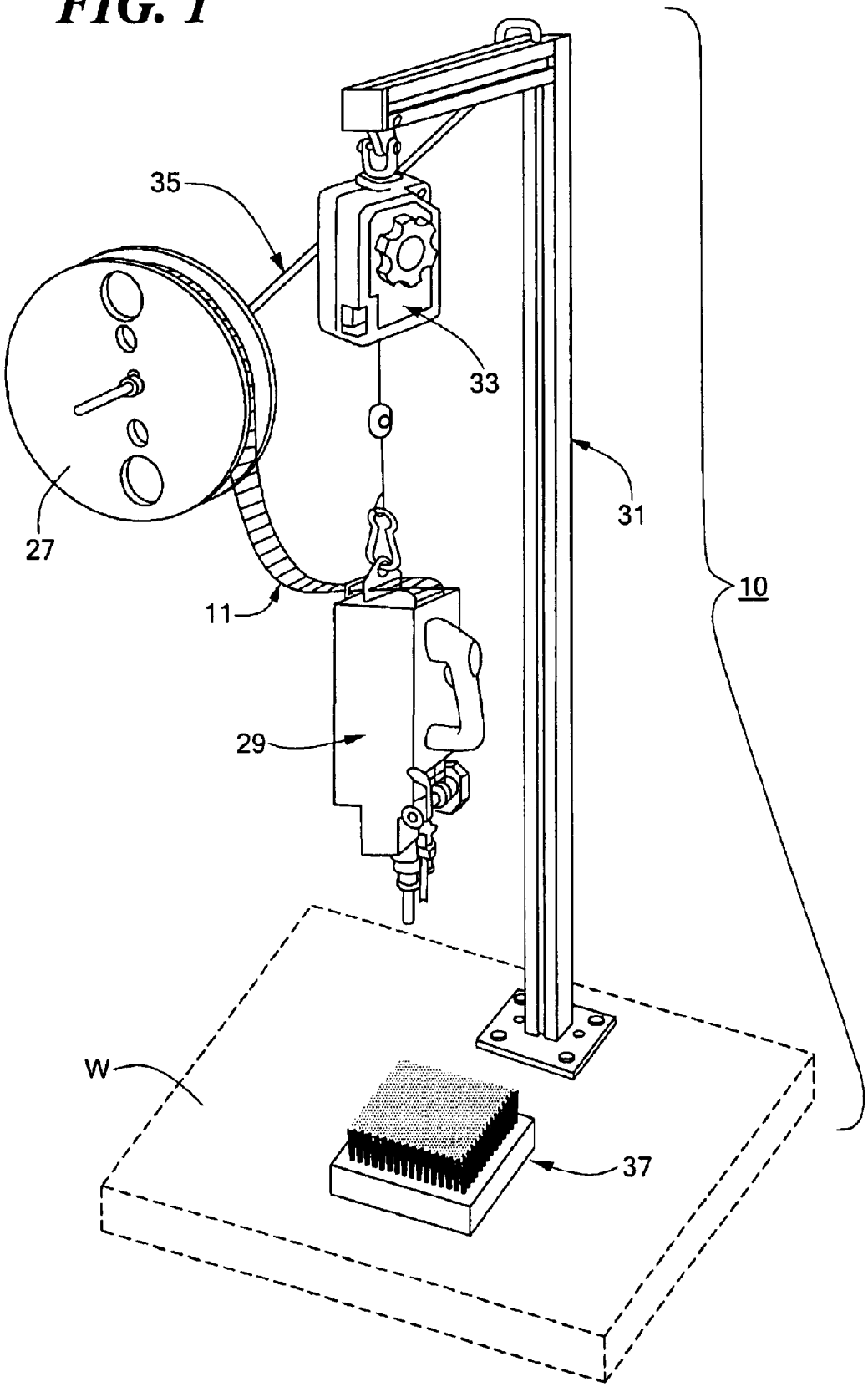
FIG. 1 is a perspective view of a variable needle system constructed according to the teachings of the present invention, the system being shown with the anvil mounted on a workstation, the workstation being shown in dashed form, the system also being shown with a supply of continuously connected ladder stock fed thereinto.

Referring now to FIG. 1, there is shown a variable needle system (VNS) constructed according to the teachings of the present invention, the system being identified generally by reference numeral 10. As will be described further in detail below, system 10 is designed for use in dispensing plastic fasteners from a supply of continuously connected ladder stock 11.

Figure 2:
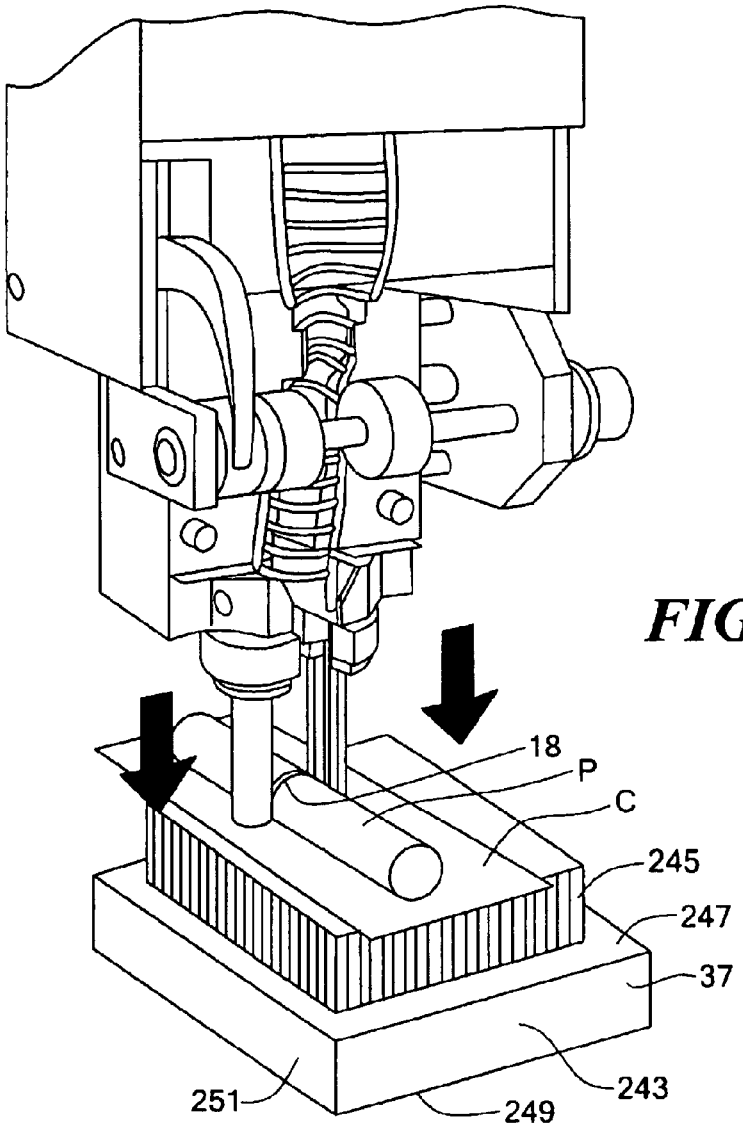
FIG. 2 is a fragmentary perspective view of the system shown in FIG. 1, the system being shown securing a product for sale onto a display card using a plastic fastener.
Figure 3:
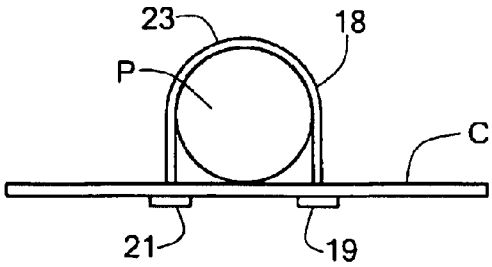
FIG. 3 is a front plan view of the product for sale secured onto the display card using a plastic fastener as shown in FIG. 2.

As such, system 10 can be used in an automated packaging line. Specifically, system 10 may be used, for example, to secure a product P for sale, such as a toy, hardware item or houseware item, onto to a cardboard display card C using one or more plastic fasteners, as shown in FIGS. 2 and 3.

Continuous Supply of Ladder Stock 11

Figure 4:
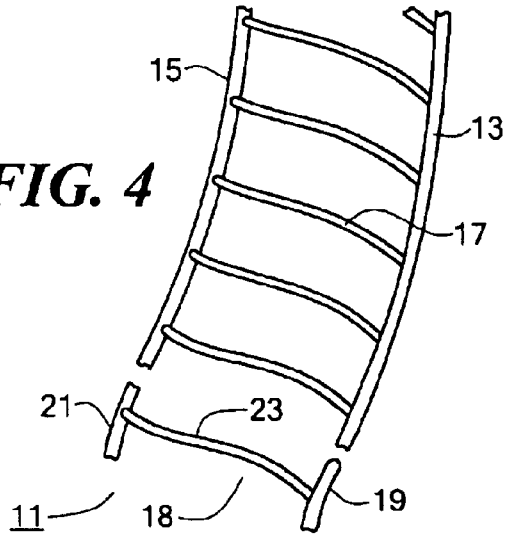
FIG. 4 is a perspective view of a length of continuously connected ladder stock which may be used with the system shown in FIG. 1.

Supply of continuously connected ladder stock 11 represents any well known continuous supply of plastic fasteners. For example, ladder stock 11 may be of the type described in U.S. Pat. No. 5,615,816 to Charles L. Deschenes et al. Specifically, FIG. 4 shows a perspective view of a prior art length of continuously connected ladder stock 11 with which the system of this invention may be used. Ladder stock 11 is preferably made of plastic and comprises a pair of side members 13 and 15 interconnected by a plurality of cross links 17. A fastener 18 which is obtained from ladder stock 11 is shown in FIG. 4 and is commonly referred to as an elastic staple in the art. Fastener 18 comprises a pair of end bars 19 and 21 which are interconnected by a filament 23, end bars 19 and 21 comprising sections of side members 13 and 15, respectively, and filament 23 comprising a cross link 17.

It should be noted that, for simplicity purposes only, system 10 will be described for use with ladder stock 11. However, it is to be understood that system 10 could be described for use with alternative types of ladder stock without departing from the spirit of the present invention. Specifically, system 10 is capable of being adjusted to accommodate changes in the size of the ladder stock to be used and also to adjust the needle spacing to accommodate changes in the size of the products with which the attachments are to be used.

It should be noted that ladder stock 11 is preferably wound onto a reel 27, reel 27 being sized and shaped to hold a supply of ladder stock 11 which includes approximately 10,000 fasteners 18. As such, the high volume reel 27 of fasteners 18 enables for continuous operation of system 10.

System 10 for Dispensing Plastic Fasteners 18

System 10 comprises a VNS module 29 for dispensing plastic fasteners 18 so as to secure a product P onto a display card C, a mounting stand 31 affixed to a workstation W, a counterbalance 33 affixed to workstation W for supporting VNS module 29, a reel holder 35 affixed to mounting stand 31 for supporting reel 27 of fastener stock 11 and an anvil 37 mounted onto workstation W for supporting product P and display card C. It should be noted that portions of system 11 not pertinent to this invention are neither shown nor described in detail herein.

VNS Module 29 for System 10

Figure 6:
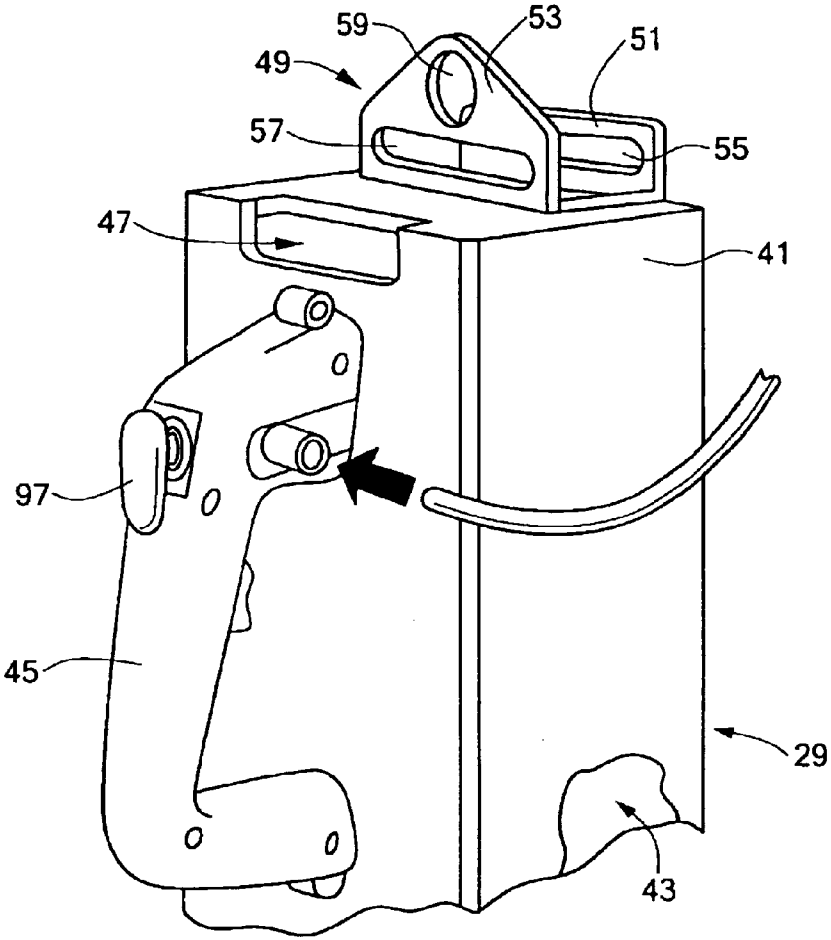
FIG. 6 is an enlarged, fragmentary, perspective view of the VNS module shown in FIG. 1.
Figure 5:
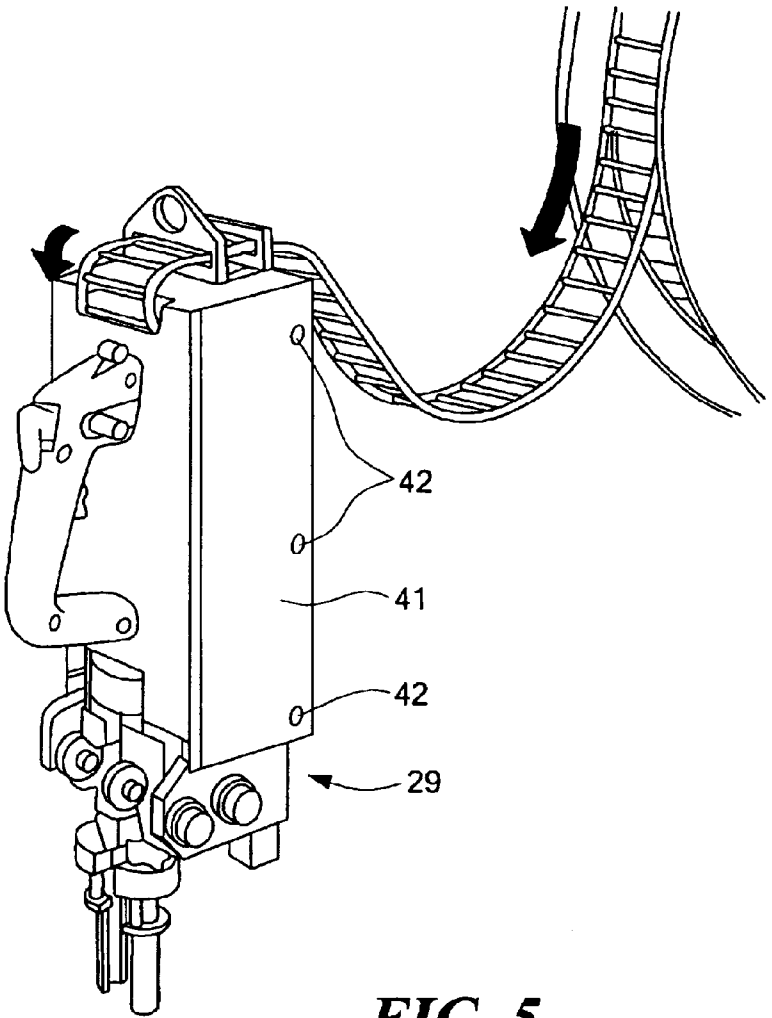
FIG. 5 is a perspective view of the VNS module shown in FIG. 1, the VNS module being shown with a supply of continuously connected ladder stock fed thereinto.
Figure 7:
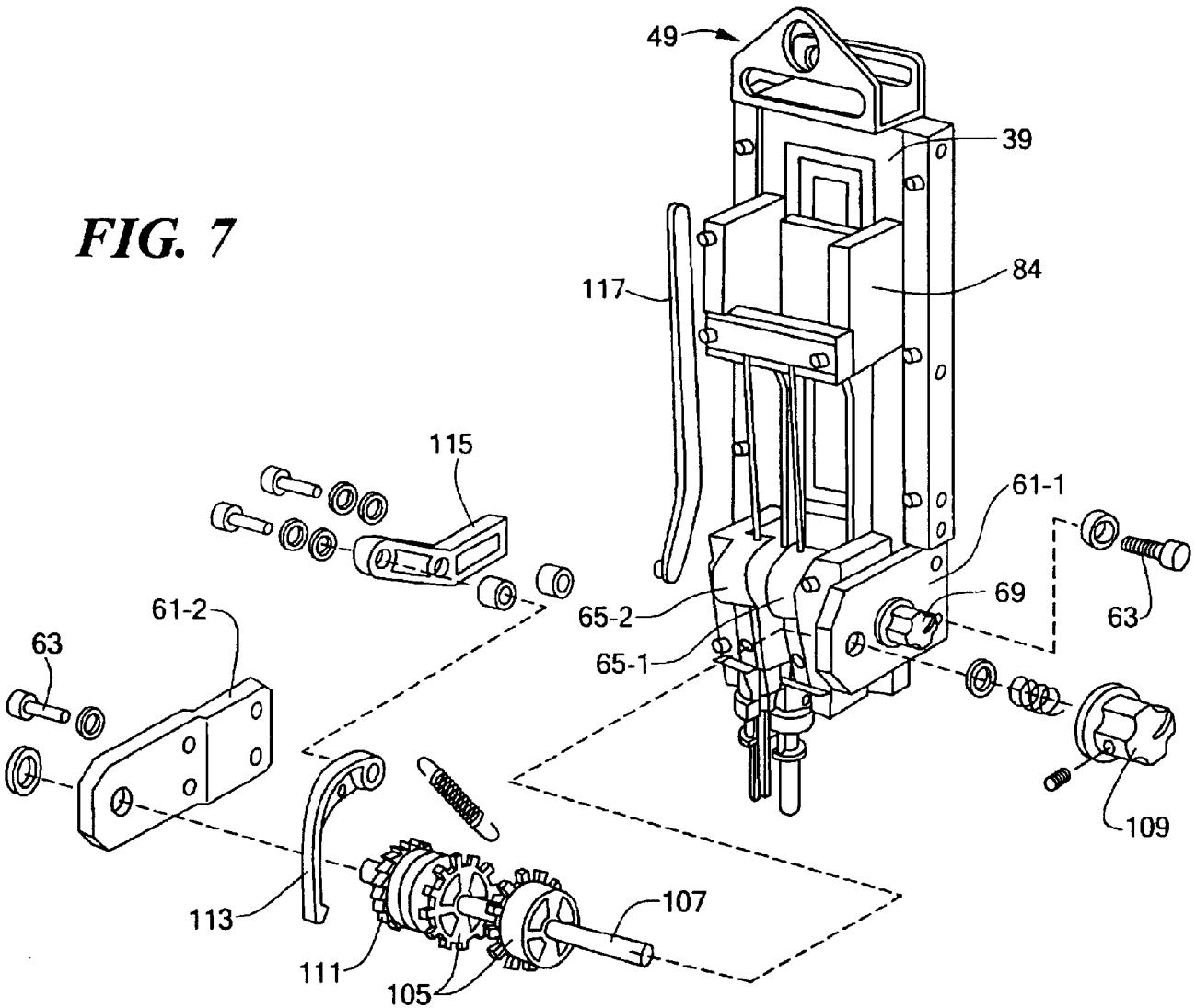
FIG. 7 is an exploded, perspective view of the VNS module shown in FIG. 1, the VNS module being shown with its enclosure removed.
Figure 8:
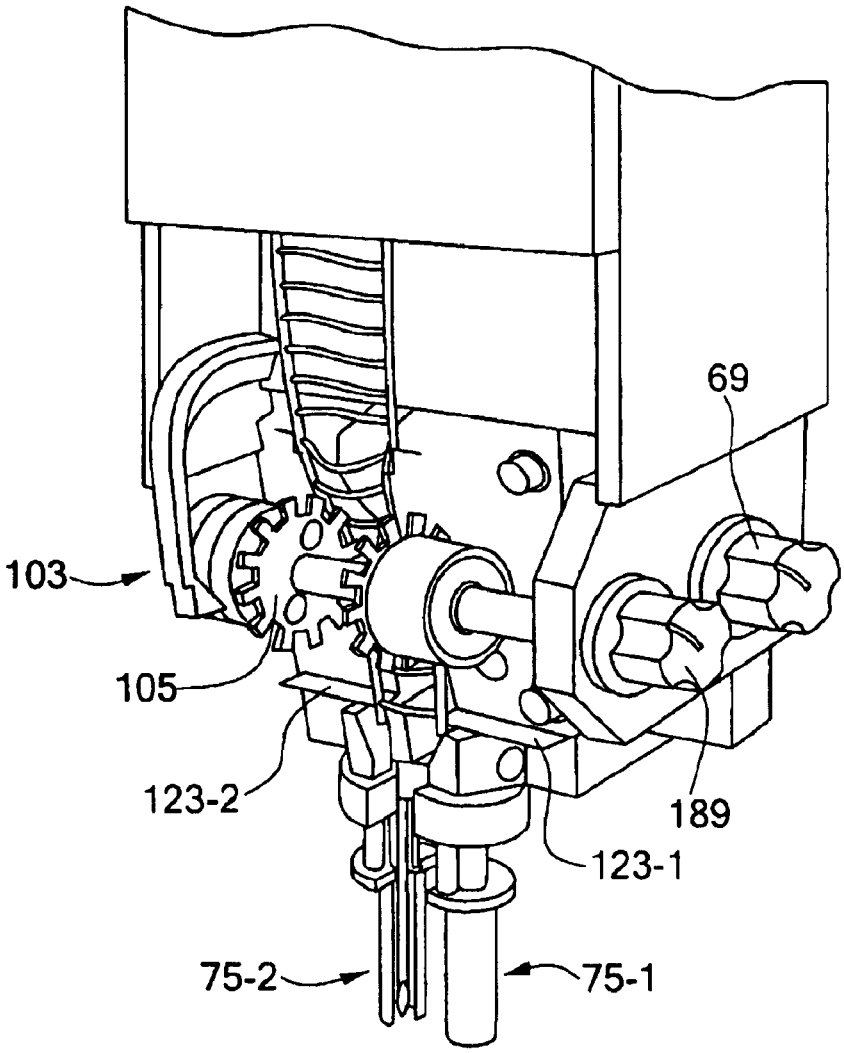
FIG. 8 is an enlarged, fragmentary, perspective view of the VNS module shown in FIG. 1.

Referring now to FIGS. 5–7, VNS module 29 comprises a frame 39 and an enclosure 41 which are secured together by a plurality of screws 42, frame 39 and enclosure 41 together defining an internal cavity 43.

A handle 45 is fixedly mounted onto the exterior of enclosure 41 and serves to enable an operator to freely handle VNS module 29. In addition, a feed guide slot 47 is formed in enclosure 41, feed guide slot 47 being in communication with internal cavity 43.

A U-shaped bracket 49 is fixedly mounted onto frame 39 and includes a first tab 51 and a second tab 53. First tab 51 of U-shaped bracket 49 extends perpendicularly away from the top of frame 39 and is shaped to include an elongated feed slot 55. Second tab 53 of U-shaped bracket 49 extends perpendicularly away from the top of frame 39 and shaped to include an elongated feed slot, or fastener guide slot, 57 and a clip opening, or tether ring, 59.

As such, supply of fastener stock 11 is fed into VNS module 29 in the following manner. Specifically, the free end of fastener stock 11 is fed from reel 27, through feed slot 55 formed in first tab 51, through feed slot 57 formed in second tab 53, down through feed guide slot 47 and into internal cavity 43, as shown in FIG. 5.

It should be noted that, by disposing tether ring 59 above fastener guide slot 57, fastener stock 11 is capable of being fed from behind VNS module 29 and into feed guide slot 47 while VNS module 29 is suspended from counterbalance 33, as shown in FIG. 1, which is highly desirable.

Needles 75 for VNS Module 29

Referring now to FIGS. 7–11, VNS module 29 further comprises first and second spaced apart support plates 61-1 and 61-2 which are affixed onto frame 39 with screws 63, support plates projecting out orthogonally from frame 39.

First and second needle blocks 65-1 and 65-2 are mounted on a shaft 67 which extends laterally between first and second support plates 61-1 and 61-2. A manually rotatable needle spacing knob 69 is fixedly mounted onto one end of shaft 67. As can be appreciated, rotation of knob 69 laterally displaces first needle block 65-1 towards and away from second needle block 65-2, second needle block 65-2 remaining at a fixed position on shaft 67. In this manner, knob 69 can be used to adjust the spacing between needle blocks 65.

First and second needle holders 71-1 and 71-2 are fixedly mounted onto first and second needle blocks 65-1 and 65-2, respectively, by screws 73.

First and second hollowed needles 75-1 and 75-2 are mounted onto first and second needle holders 71-1 and 71-2, respectively. Each needle 75 is conventional in construction and includes a first end 77, a second end 79, an elongated channel 81 and an elongated slot 83 in communication with elongated channel 81. First end 77 of each needle 75 is sized and shaped to be fittingly disposed within a needle receptacle 78 formed in its associated needle holder 71, thereby enabling each needle 75 to project perpendicularly out from its associated needle holder 71. Second end 79 of each needle 75 is in the form of a spoon-shaped sharpened tip through which an end bar of fastener 18 may pass during the dispensing process.

Figure 11:
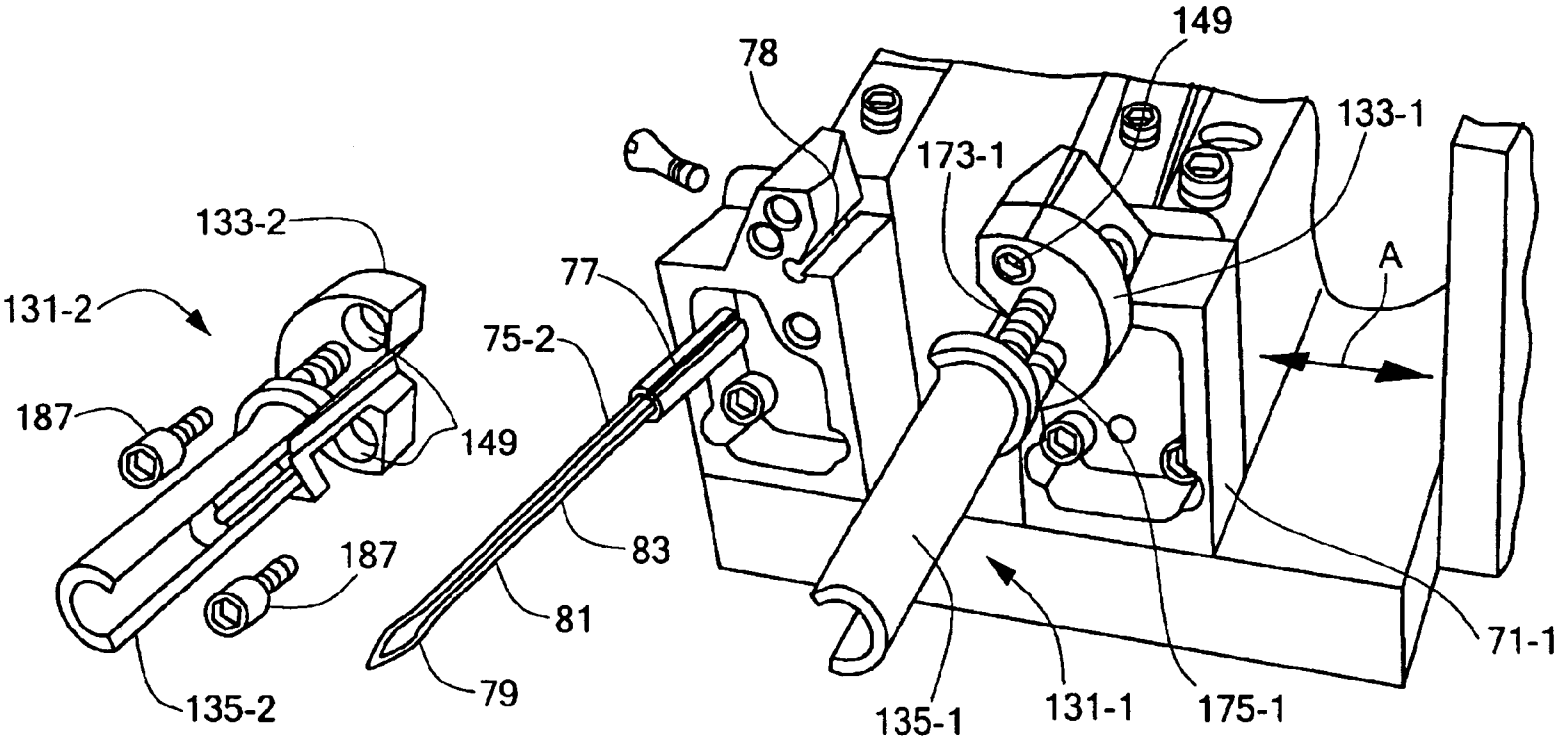
FIG. 11 is an enlarged, exploded, fragmentary, perspective view of selected components of the VNS module shown in FIG. 1.

As can be appreciated, the rotation of knob 69 enables needle 75-1 to slide laterally, as represented by arrow A in FIG. 11, towards and away from fixed needle 75-2 in order to adjust the spacing between needles 75.

Ejection Mechanism 84 for VNS Module 29

Figure 9:
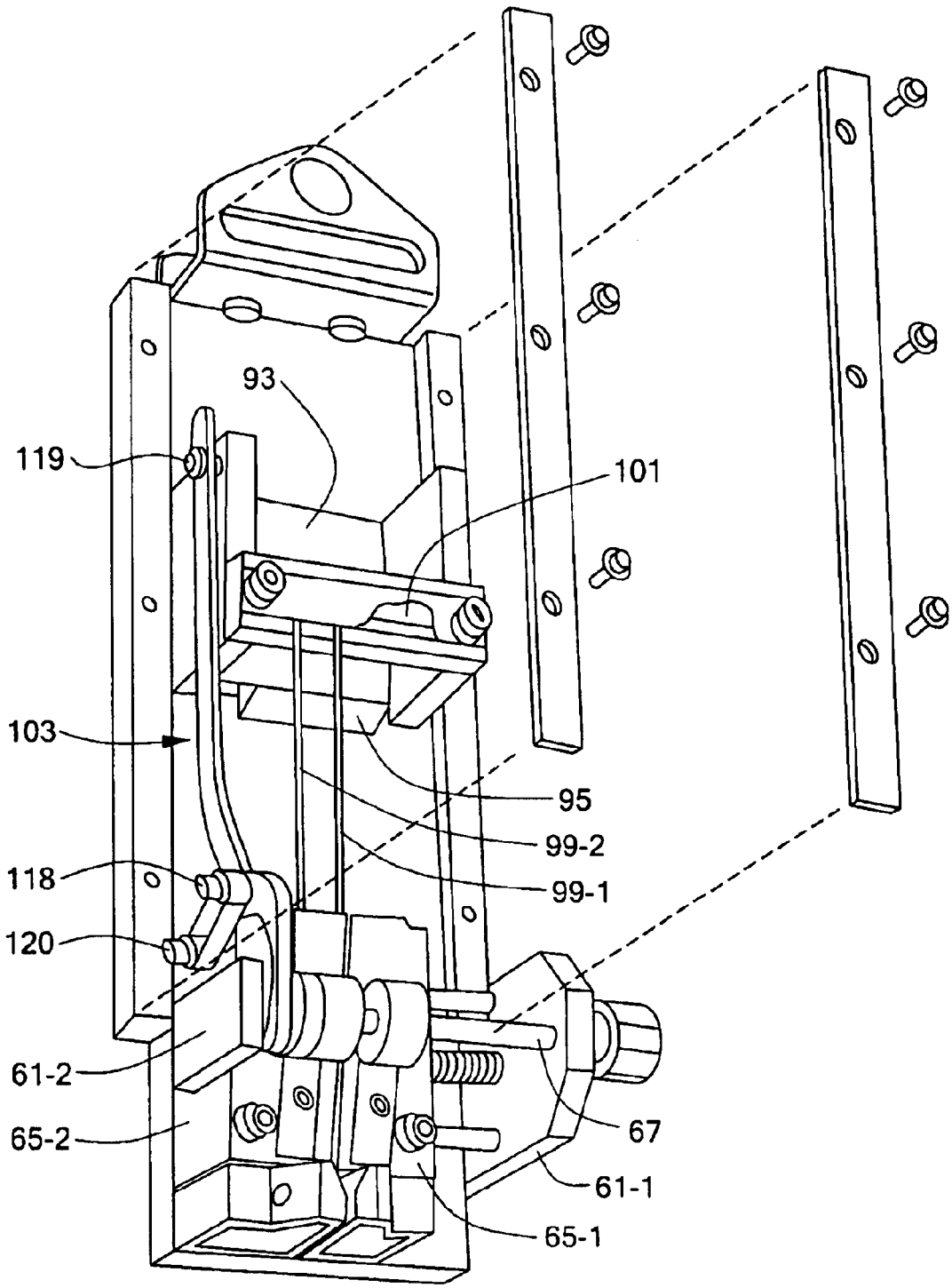
FIG. 9 is an enlarged, fragmentary, perspective view of selected components of the VNS module shown in FIG. 1.
Figure 12:
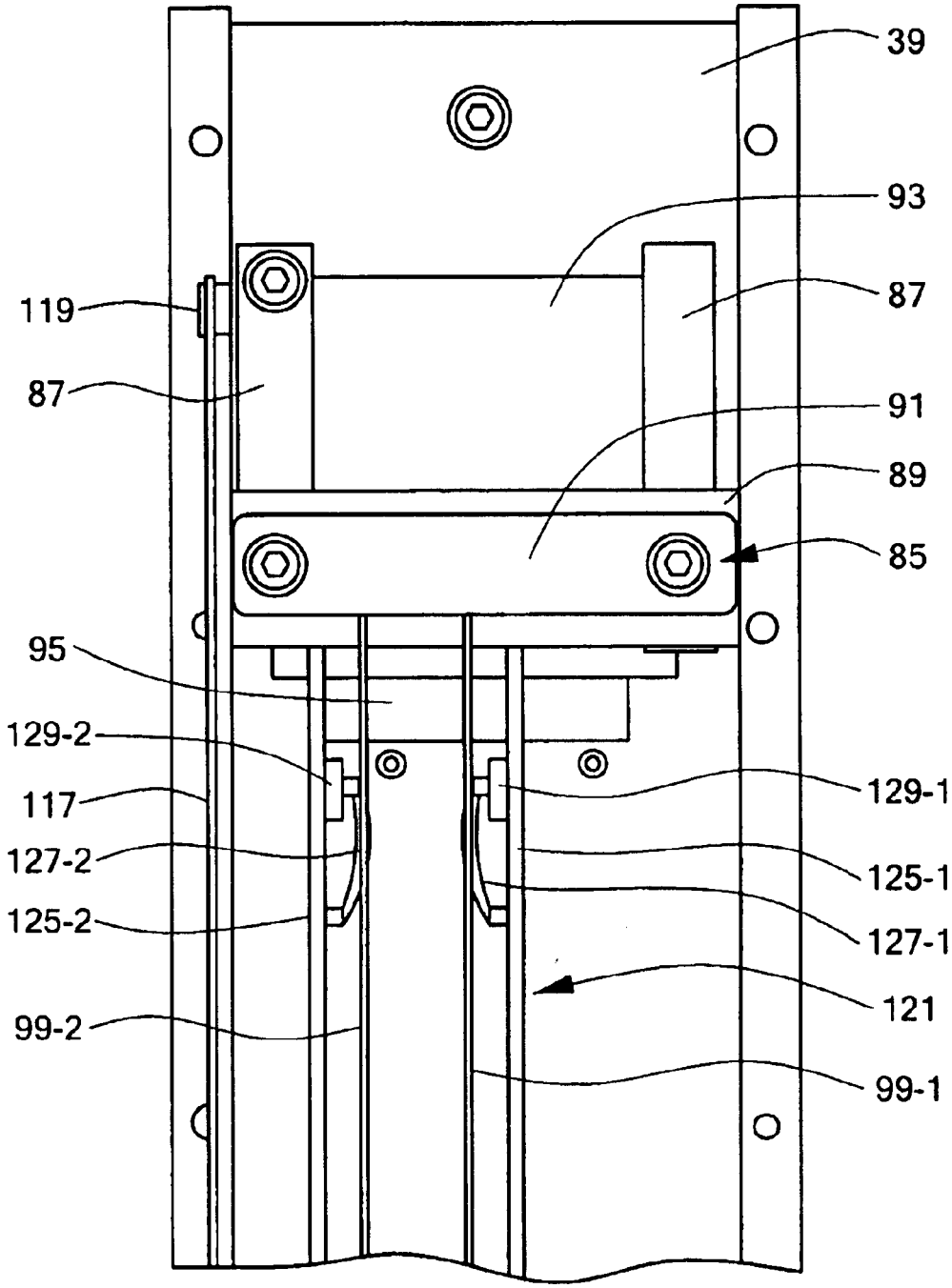
FIG. 12 is a enlarged, fragementary, front plan view of the VNS module shown in FIG. 1, the VNS module being shown with its enclosure removed.

Referring now to FIGS. 7, 9 and 12, VNS module 29 also comprises an ejection mechanism 84 for dispensing a fastener 18 out through needles 75. Ejection mechanism 84 includes an ejector rod slide 85 which is adapted to slide vertically along frame 39, said ejector rod slide 85 comprising a pair of spaced apart sidewalls 87, a top wall 89 affixed to sidewalls 87, a plate 91 affixed to top wall 89, a bottom wall 93 affixed to sidewalls 87 and a ramp 95 formed onto bottom wall 93. Ejector rod slide 85 is powered for vertical displacement by an pneumatic system (not shown) which operates on 80 psi. Application of air pressure from the pneumatic system is achieved through the depression of an actuation button 97 formed on handle 45.

Ejection mechanism 84 also includes first and second ejector rods 99-1 and 99-2 which are disposed within a slot 101 formed into top wall 89 and are retained therein through the mounting of plate 91 onto top wall 89. Ejector rods 99-1 and 99-2 are positioned to extend down through needle blocks 65-1 and 65-2, respectively. Accordingly, as ejector rod slide 85 travels downward, first and second ejector rods 99-1 and 99-2 project into channel 81 of first and second needles 75-1 and 75-2, respectively, so as to dispense fastener 18 out from VNS module 29.

As can be appreciated, ejector rod slide 85 is adapted to slide vertically along frame 39 and includes a downward stroke in which first and second ejector rods 99-1 and 99-2 project into channel 81 of first and second needles 75-1 and 75-2, respectively, and an upward stroke in which first and second ejector rods 99-1 and 99-2 retract from needles 75-1 and 75-2, respectively.

It should be noted that the construction and functionality of ejection mechanism 84 does not serve as a principal feature of the present invention. As a result, it is to be understood that ejection mechanism 84 could be of the type disclosed in U.S. Pat. No. 5,615,816 to Charles L. Deschenes et al. without departing from the spirit of the present invention.

Feed Mechanism 103 for VNS Module 29

VNS module 29 further comprises a feed mechanism 103 for continuously advancing fastener stock 11 therethrough. Feed mechanism 103 comprises a pair of spaced apart, sprocket feed wheels 105 which are fixedly mounted onto a shaft 107, as shown in FIG. 7. Feed wheels 105 are adapted to engage the filaments 23 of fasteners 18 to advance the supply of fastener stock 11 through VNS module 29. A feed knob 109 is fixedly mounted onto shaft 107 to allow for manual advancement of fastener stock 11 through module 29, which is highly desirable.

A ratchet wheel 111 is fixedly mounted onto shaft 107 and a pivotable feed pawl 113 is adapted to selectively engage ratchet wheel 111. As such, the pivoting of feed pawl 113 serves to rotate ratchet wheel 111 which, in turn, drives feed wheels 105, thereby disposing the lowermost fastener 18 in fastener stock 11 into position at the rear end of hollowed needles 75 for subsequent ejection.

Feed pawl 113 is, in turn, connected to a pivotable feed lever 115 and a movable feed link 117 by a bolt 118. As can be appreciated, as ejector rod slide 85 completes its upward stroke, a bolt 119 engages feed link 117 and pulls feed link 117 upwards. The upward displacement of feed link 117, in turn, causes feed pawl 113 to pivot about a pivot point 120 on feed lever 115, thereby advancing fastener stock 11 through VNS module 29.

It should be noted that the construction and functionality of feed mechanism 103 does not serve as a principal feature of the present invention. As a result, it is to be understood that feed mechanism 103 could be of the type disclosed in U.S. Pat. No. 5,615,816 to Charles L. Deschenes et al. without departing from the spirit of the present invention.

Severing Mechanism 121 for VNS Module 29

Figure 10:
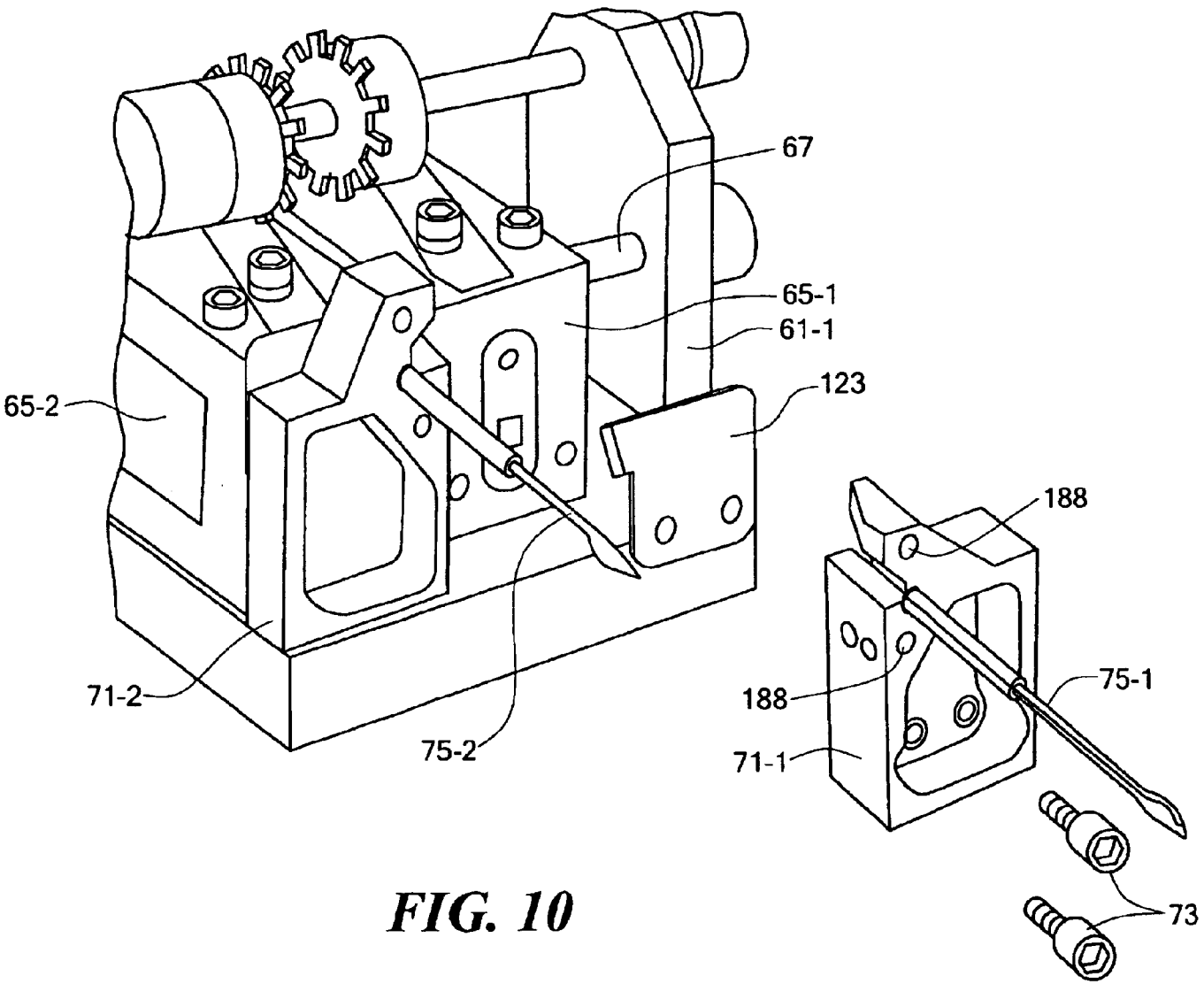
FIG. 10 is an enlarged, exploded, fragmentary, perspective view of selected components of the VNS module shown in FIG. 1.

VNS module 29 additionally comprises a severing mechanism 121 for severing the lowermost fastener 18 from fastener stock 11 prior to ejection through neeedles 75. Severing mechanism 121 comprises a pair of knife blades 123-1 and 123-2, each blade 123 being pivotably disposed between an associated needle block 65 and needle holder 71, as shown in FIG. 10.

Severing mechanism 121 also comprises a pair of knife levers 125-1 and 125-2 connected to knife blades 123-1 and 123-2, respectively. A pair spring-biased knife pivots 127-1 and 127-2 are connected to knife levers 125-1 and 125-2, respectively. A pair of knife rollers 129-1 and 129-2 are connected to knife pivots 127-1 and 127-2, respectively. As can be appreciated, knife rollers 129 are biased downward so as to continuously contact frame 39. Accordingly, as ejector rod slide 85 begins its downward stroke, knife rollers 129 travel up and over ramp 95. As knife rollers 129 travel up and over ramp 95, knife rollers 129 pivot knife pivots 127 which, in turn, pull knife levers 125. Resultingly, the pulling of knife levers 125 inwardly pivots knife blades 123, thereby severing the lowermost fastener 18 from fastener stock 11. It should be noted that spring-biased knife pivots 127 are designed only to pull knife levers 125 when as ejector rod slide 85 begins its downward stroke and not when ejector rod slide 85 completes its upward stroke.

It should be noted that the construction and functionality of severing mechanism 121 does not serve as a principal feature of the present invention. As a result, it is to be understood that severing mechanism 121 could be of the type disclosed in U.S. Pat. No. 5,615,816 to Charles L. Deschenes et al. without departing from the spirit of the present invention.

Retractable Needle Guard Assemblies 131 for VNS Module 29

VNS module 29 further comprises first and second retractable needle guard assemblies 131-1 and 131-2 which are disposed over first and second hollowed needles 75-1 and 75-2, respectively.

It should be appreciated, the particular construction and functionality of retractable needle guard assemblies 131 serve as a principal feature of the present invention. In addition, it should be noted that first and second retractable needle guard assemblies 131-1 and 131-2 are identical in construction. As a result, for simplicity purposes only, the details of first and second needle guard assemblies 131-1 and 131-2 will be described only with respect to first needle guard assembly 131-1.

First retractable needle guard assembly 131-1 comprises a fixedly mounted needle guard 133-1 which is affixed onto its associated needle holder 71-1 over needle 75-1 and a movable needle guard 135-3 which is slidably mounted on fixedly mounted needle guard 133-1.

Figure 13:
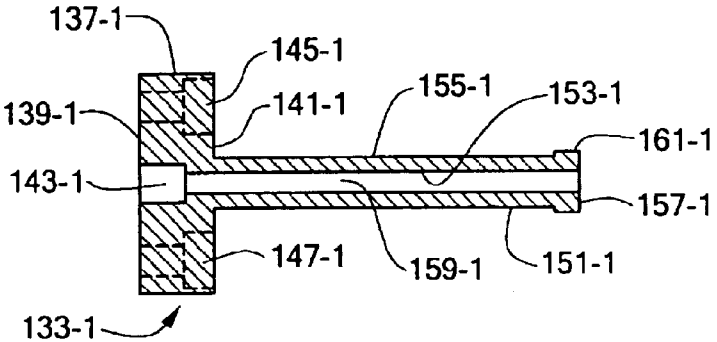
FIG. 13 is a side view of the fixedly mounted needle guard of the first retractable needle guard assembly shown in FIG. 1.

Referring now to FIGS. 11 and 13, fixedly mounted needle guard 133-1 comprises a base 137-1 in the shape of a half-disc which includes a substantially flat top surface 139-1 and a substantially flat bottom surface 141-1. Base 137-1 also includes a central needle bore 143-1, first guide pin bore 145-1, second guide pin bore 147-1 and a pair of mounting screw bores 149 pre-formed therein pre-formed therein.

Fixedly mounted needle guard 133-1 further includes an elongated, C-shaped in lateral cross-section, inner sleeve 151-1 which is integrally formed onto and extends orthogonally out from bottom surface 141-1 of base 137-1. Inner sleeve 151-1 includes an inner surface 153-1, an outer surface 155-1 and a free end 157-1, inner sleeve 151-1 being shaped to define an elongated central channel 159-1 which is sized and shaped to receive associated needle 75-1, as shown in phantom in FIGS. 15 and 16. Outer surface 155-1 of inner sleeve 151-1 is shaped to include an enlarged flange 161-1 proximate free end 157-1.

Figure 14:
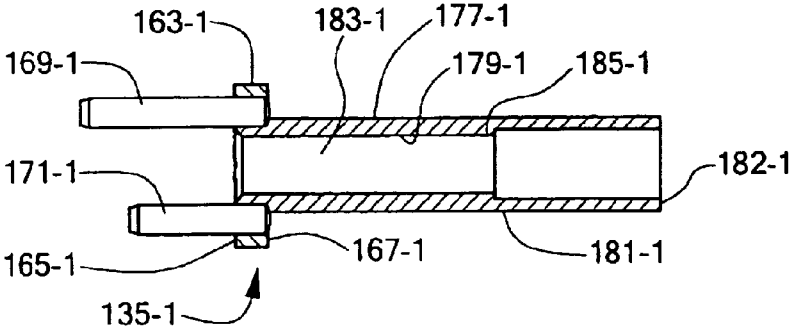
FIG. 14 is a side view of the movable needle guard of the first retractable needle guard assembly shown in FIG. 1.

Referring now to FIGS. 11 and 14, movable needle guard 135-1 is slidably mounted over fixedly mounted needle guard 133-1 and comprises a collar 163-1 having a top surface 165-1 and a bottom surface 167-1. Movable needle guard 135-1 also includes first and second guide pins 169-1 and 171-1 which are integrally formed onto and extend orthogonally out from top surface 165-1 of collar 163-1, first and second guide pins 169-1 and 171-1 being sized and shaped to project into first and second guide pin bores 145-1 and 147-1, respectively. First and second compression springs 173-1 and 175-1 are sized and shaped to be slidably mounted onto first and second guide pins 169-1 and 171-1, respectively.

Movable needle guard 135-1 further includes an elongated, C-shaped in lateral cross-section, outer sleeve 177-1 which is integrally formed onto and extends orthogonally out from bottom surface 167-1 of collar 163-1. Outer sleeve 177-1 includes an inner surface 179-1, an outer surface 181-1, a free end 182-1 and is shaped to define an elongated central channel 183-1 which is sized and shaped to receive inner sleeve 151-1 of fixedly mounted needle guard 133-1. Inner surface 179-1 of outer sleeve 177-1 is shaped to include a stop 185-1.

Accordingly, with needle 75-1 mounted onto needle holder 71-1, with first end 77 of needle 75-1 fittingly disposed within its associated needle receptacle 78 in needle holder 71-1, needle guard assembly 131-1 is mounted onto its associated needle holder 71-1 over its associate needle 75-1. Specifically, top surface 139-1 of base 137-1 is disposed against the bottom surface of needle holder 71-1. Screws 187 are then disposed through first and second mounting screw bores 149-1 and 151-1, respectively, in base 137-1 and into engagement within associated threaded bores 188 formed in needle holder 71-1, thereby fixedly securing needle guard assembly 131-1 onto needle holder 71-1 over needle 75-1.

As can be appreciated, with needle guard assembly 131-1 mounted onto its associated needle holder 71-1 over needle 75-1, each of first and second compression springs 173-1 and 175-1 is disposed to contact top surface 165-1 of collar 163-1 at one end and bottom surface 141-1 of needle holder 71-1 at the other end. As such, compression springs 173-1 and 175-1 resiliently urge collar 163-1 away from base 137-1, thereby enabling for guard assembly 131-1 to be disposed between a protective position and retracted position.

Figure 15:
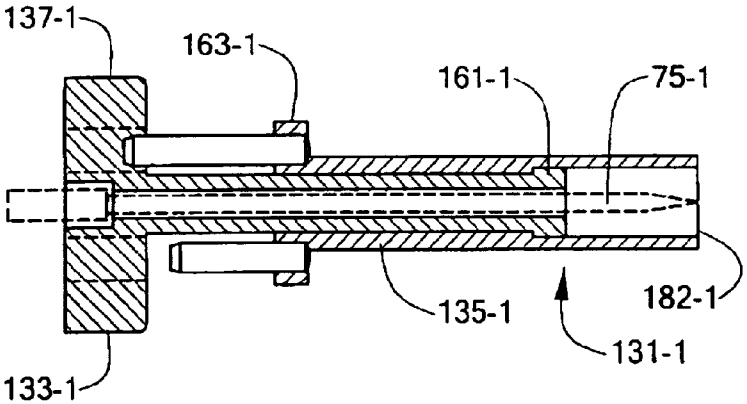
FIG. 15 is a side view of the first retractable needle guard assembly shown in FIG. 1, the first retractable needle guard assembly being shown in its protective position and disposed over a needle, the needle being shown in dashed form.

With needle guard assembly 131-1 disposed in its protective position, as shown in FIG. 15, compression springs 173-1 and 173-2 urge collar 163-1 away from base 137-1 until enlarged flange 161-1 of fixedly mounted needle guard 133-1 abuts against stop 185-1 formed in movable needle guard 135-1, thereby precluding further movement of movable needle guard 135-1 away from fixed needle guard 133-1. With needle guard assembly 131-1 disposed in its protective position, free end 182-1 of movable needle guard 135-1 extends just beyond the sharpened tip of the needle 75-1, thereby covering needle 75-1.

Figure 16:
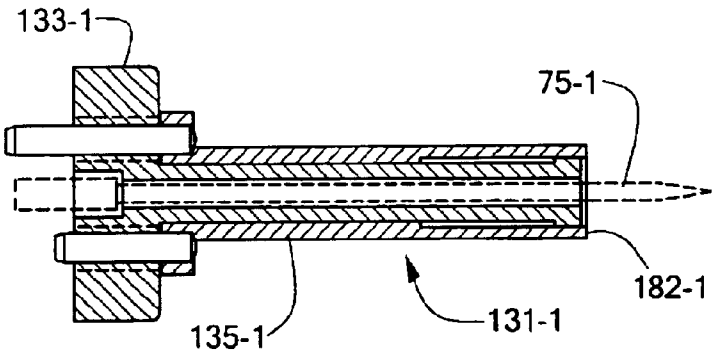
FIG. 16 is a side view of the first retractable needle guard assembly shown in FIG. 1, the first retractable needle guard assembly being shown in its retracted position and disposed over a needle, the needle being shown in dashed form.

With needle guard assembly 131-1 disposed in its retracted position, as shown in FIG. 16, an upward force greater than the force of the compression springs 173-1 and 175-1 is applied onto free end 182-1 of movable needle guard 135-1, thereby displacing movable needle guard 135-1 upward relative to fixed needle guard 133-1 until top surface 165-1 of collar 163-1 is in contact against bottom surface 141-1 of base 137-1 and until free end 182-1 of outer sleeve 177-1 is substantially flush with free end 157-1 of inner sleeve 151-1. With needle guard assembly 131-1 disposed in its retracted position, a fixed length of needle 75-1 is exposed.

As can be appreciated, retractable needle guard assemblies 131 provide three principal advantages.

As a first advantage, retractable needle guard assemblies 131 provide increased safety for the operator by preventing inadvertent contact of the sharpened point of hollowed needles 75 when VNS module 29 is not in use, which is highly desirable.

As a second advantage, retractable needle guard assemblies 131 serve as a stiffening, or support, device for needles 75, thereby preventing needle bending and/or breakage, which highly desirable.

As a third advantage, retractable needle guard assemblies 131 serve as a needle stop for limiting the depth which needles 75 can be inserted through display card C. Specifically, needle guard assemblies 131 limit the length of needle 75 which can be inserted through display card C to a fixed constant length. In particular, the portion of each needle 75 from the sharpened tip at second end 79 to free end 182 of outer sleeve 177 is able to penetrate through display card C when needle guard assemblies 131 are in their retracted position. It should be noted that a constant degree of insertion of needles 75 through display card C is highly desirable because if needles 75 are over inserted through display card C, fastener 18 can become overstretched and will break during ejection, which is highly undesirable. Furthermore, if needles 75 are under inserted through display card C, fastener 18 will not adequately penetrate through display card C, thereby precluding proper coupling, which is highly undesirable.

Mounting Stand for 31 System 10

Mounting stand 31 is installed onto workstation W and supports counterbalance 33 and reel holder 35.

Figure 18:
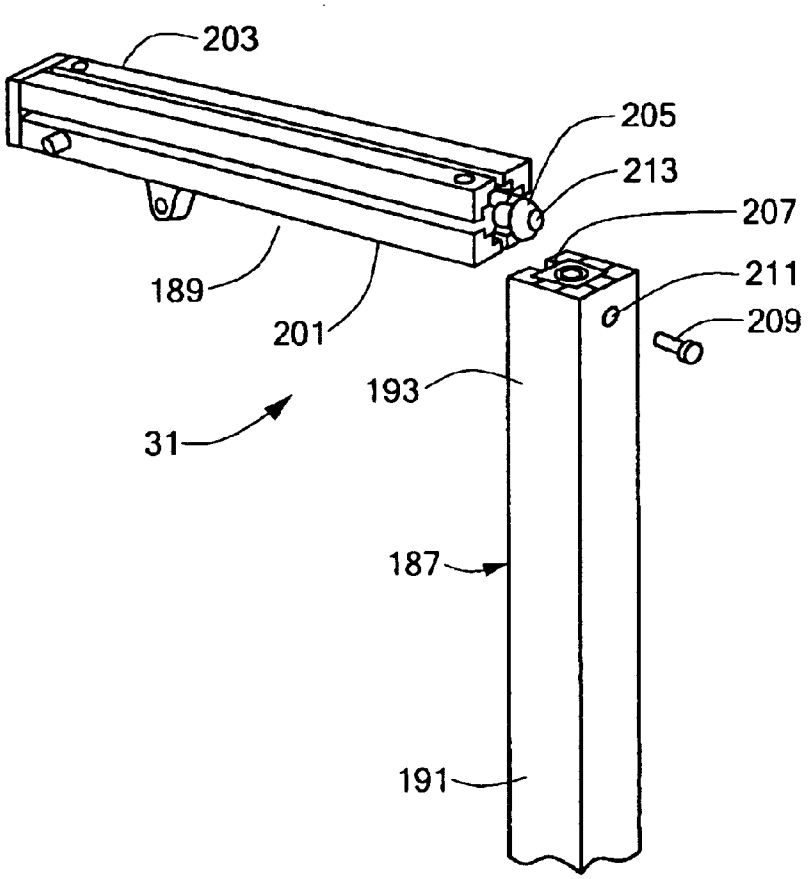
FIG. 18 is a fragmentary, exploded, perspective view of the mounting stand shown in FIG. 1, the mounting stand being shown mounted on a workstation, the workstation being shown in dashed form.
Figure 17:
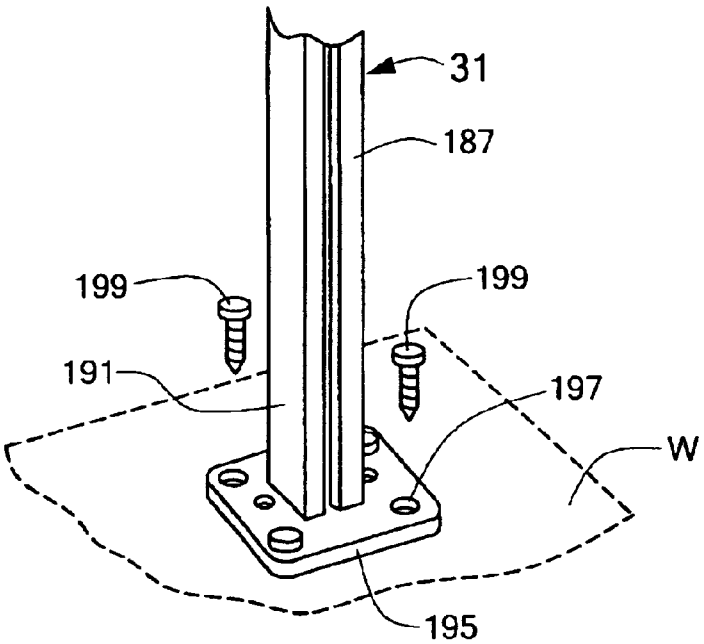
FIG. 17 is a fragmentary, exploded, perspective view of the mounting stand shown in FIG. 1, the mounting stand being shown mounted on a workstation, the workstation being shown in dashed form.

Referring now to FIGS. 17 and 18, mounting stand 31 is generally L-shaped and includes a vertical leg 187 and a horizontal leg 189 which are affixed together.

Vertical leg 187 is substantially straight and includes a first end 191 and a second end 193. A flat support plate 195 is affixed onto first end 191 of vertical leg 187. Flat support plate 195 is shaped to include a plurality of preformed holes 197. As such, a screw 199 can be disposed through each preformed hole 197 in support plate 195 and down into engagement into workstation W so as to fixedly secure vertical leg 187 onto workstation W, vertical leg 187 extending orthogonally from the top surface of workstation W.

Horizontal leg 189 is substantially straight and includes a first end 201 and a second end 203. A projection 205 is formed onto first end 201 of horizontal leg 189 and is sized and shaped to fit within a slot 207 formed in second end 193 of vertical leg 187, as shown in FIG. 18. A screw 209 is disposed through an opening 211 formed in second end 193 of vertical leg 187 and into threaded engagement within an opening 213 in projection 205 of horizontal leg 189 so as to fixedly secure horizontal leg 189 onto vertical leg 187 in such a manner that horizontal leg 189 extends generally orthogonally from vertical leg 187.

Counterbalance 33 for System 10

Counterbalance 33 is affixed onto mounting stand 31 and serves to support VNS module 29.

Figure 19:
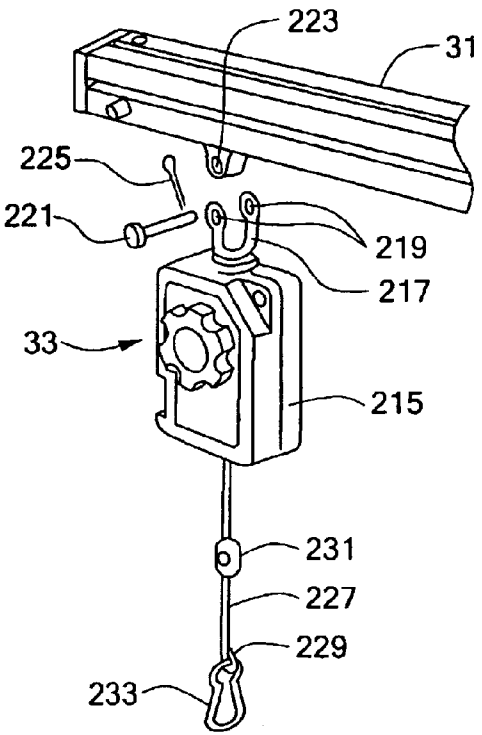
FIG. 19 is a fragmentary exploded, perspective view of the counterbalance and mounting stand shown in FIG. 1.

Referring now to FIG. 19, counterbalance 33 includes a box-shaped housing 215 and a U-shaped bracket 217 affixed onto housing 215, U-shaped bracket 217 being shaped to includes a pair of openings 219. A pin 221 is sized and shaped to be disposed through openings 219 in U-shaped bracket 217 and through an opening 223 formed in horizontal leg 189, thereby securing counterbalance 33 onto horizontal leg 189. A cotter pin 225 is sized and shaped to be slidably disposed through an opening (not shown) formed in pin 221, so as to retain pin 221 through U-shaped bracket 217 and opening 223 in horizontal leg 189.

Counterbalance 33 is conventional in construction and includes a tether 227 which is wound within housing 215 and which includes a free end 229 disposed outside housing 215. As can be appreciated, free end 229 of tether 227 can be pulled away from housing 215. However, in the absence of the pulling force, tether 227 resiliently pulls free end 229 back to housing 215, a stop 231 proximate free end 229 limiting the retraction. A clip 233 is formed onto free end 229 of tether 227 and is sized and shaped to releasably dispose into and engage clip opening 59 in bracket 49.

Reel Holder 35 for System 10

Reel holder 35 is affixed onto mounting stand 31 and serves to support reel 27 of fastener stock 11.

Figure 20:
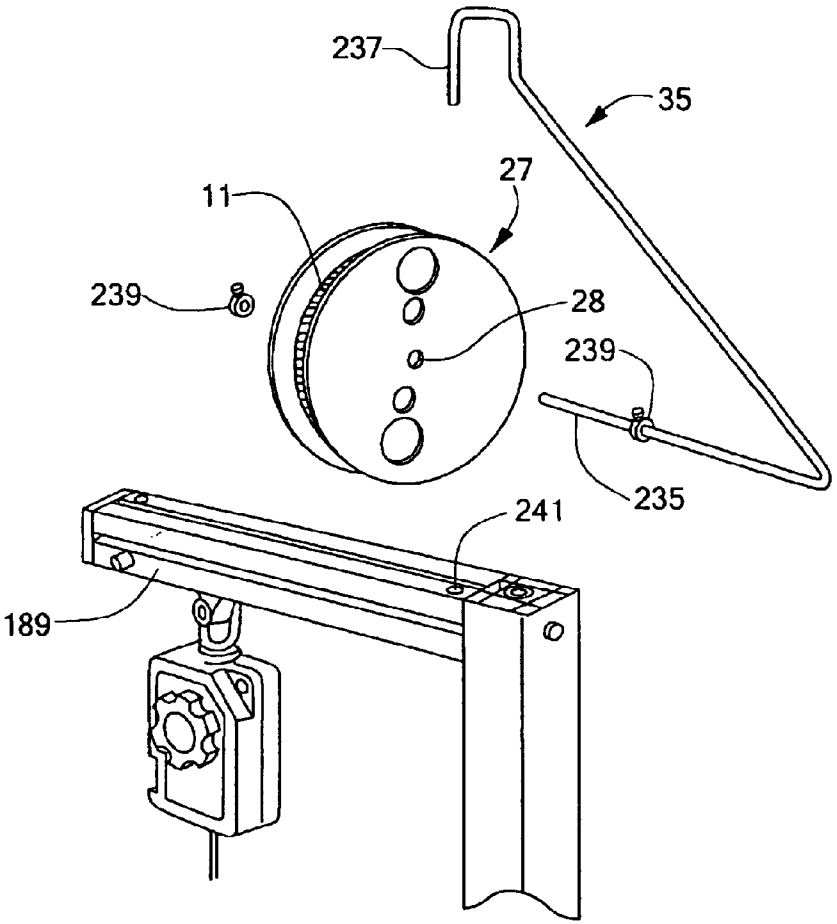
FIG. 20 is a fragmentary, exploded, perspective view of the counterbalance, mounting stand, reel holder and continuous supply of fastener stock shown in FIG. 1.

Referring now to FIG. 20, reel holder 35 is in the form of a stiffened wire and comprises a first end 235 and a second end 237.

First end 235 of reel holder 35 is sized and shaped to extend horizontally through a central opening 28 formed in reel 27, thereby enabling reel holder 35 to support reel 27 of fastener stock 11. A pair of retainer clips 239 are sized and shaped to fixedly mount onto first end 235 of reel holder 35 on opposite sides of reel 27, thereby securing reel 27 onto first end 235 of reel holder 35 but enabling reel 27 to rotate on reel holder 35 without interference.

Second end 237 is sized and shaped to extend vertically down into a reel holder opening 241 formed into horizontal leg 189. As such, reel holder 35 supports reel 27 from horizontal leg 189 of mounting stand 31, as shown in FIG. 1.

Anvil 37 for System 10

Anvil 37 is mounted onto workstation W and serves to support product P and display card C during the fastening process.

Referring now to FIG. 2, anvil 37 preferably comprises a support block 243 and a plurality of filaments 245 disposed into support block 243.

Support block 243 is preferably constructed of polyvinyl chloride (PVC) and comprises a substantially flat top surface 247, a substantially flat bottom surface 249 and four sidewalls 251. Support block 243 has a length of approximately 4.0 inches, a width of approximately 4.0 inches and a thickness of approximately 0.75 inches.

A plurality of openings (not shown) are formed into top surface 247 of support block 243 and extend down a portion of the distance from top surface 247 towards bottom surface 249. Each opening is generally circular in lateral cross-section with a diameter of approximately 0.098 inches. A tuft of nylon brush filaments 245 is disposed into each opening to form anvil 37.

Operation of System 10

In use, system 10 can be used to affix a product for sale P onto a display card C using one or more plastic fasteners 18 from fastener stock 11 in the following manner. Display card C is placed on top of filaments 245 of anvil 37 and product P for sale, in turn, is placed on top of display card C, as shown in FIG. 2. The user then grasps handle 45 of VNS module 29 and urges it downward so that needles 75 pierce through display card C, needles 75 being disposed on opposite sides of product P for sale. Needles 75 are disposed through display card C and down between filaments 245 of anvil 37. It should be noted that VNS module 29 is urged downward until needle guard assemblies 131 are in their fully retracted position. As such, needle guard assemblies 131 serve to accurately limit the degree of insertion of needles 75 through display card C, which is highly desirable. With needles 75 disposed through display card C and with needle guard assemblies 131 disposed in their fully retracted position, actuation button 97 is depressed so as to eject a single fastener 18 out through needles 75. The ejection of single fastener 18 disposes end bars 19 and 21 on the opposite side of display card C than product P, filament 23 of fastener 18 being drawn tightly against product P so as to securely couple product P to display card C, as shown in FIG. 3.

The process can be repeated as necessary, wherein a subsequent depression of actuator button 97 ejects another fastener 18 out through needles 75. Accordingly, because a continuous supply of fastener stock 11 can be loaded into VNS module 29, it is to be understood that system 10 can be used to continuously apply fasteners 18 without reloading.

It should be noted that counterbalance 33 enables VNS module 29 to be easily handled by the user during high volume packaging operations, such as assembly line packaging, which is highly desirable. Furthermore, it should be noted that supporting VNS module 29 onto counterbalance 33 is made possible by providing anvil 37 and needle guard assemblies 131 on VNS module 29 to ensure that fastener 18 is properly disposed through display card C.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A module for dispensing a plastic fastener from a reel of fastener stock to couple together two or more objects, said module comprising:

(a) a hollowed needle having a sharpened tip, (b) a needle holder for holding said hollowed needle, (c) a retractable needle guard assembly coupled to said needle holder at least a portion of said retractable needle guard assembly being adapted to slide along at least a portion of the length of said hollowed needle, (d) a feed mechanism for advancing the fastener stock into said hollowed needle, (e) a severing mechanism for severing the fastener to be dispensed through said hollowed needle from the fastener stock, and (f) an ejection mechanism for ejecting the severed fastener through said hollowed needle.

2. The module of claim 1 wherein said retractable needle guard assembly can be disposed between a protective position in which said retractable needle guard assembly extends along at least the length of said hollowed needle and a retracted position in which said retractable needle guard assembly extends along a portion of the length of said hollowed needle so as to expose the sharpened tip.

3. The module of claim 2, wherein said retractable needle guard assembly further comprises at least one compression spring for resiliently urging said retractable needle guard assembly into its protective position.

4. The module of claim 2 further comprising a handle for holding said module and an actuation button on said handle for activating the ejection mechanism of said module.

5. The module of claim 1 wherein said retractable needle guard assembly is mounted over said hollowed needle.

6. The module of claim 1 wherein said retractable needle guard assembly is telescopingly mounted over said hollowed needle.

7. The module of claim 1 wherein said retractable needle guard assembly is coaxially mounted over said hollowed needle.

8. A module for dispensing a plastic fastener from a reel of fastener stock to couple together two or more objects, said module comprising:

(a) a hollowed needle having a sharpened tip, (b) a needle holder for holding said hollowed needle, (c) a retractable needle guard assembly mounted onto said needle holder over said hollowed needle, said retractable needle guard assembly being disposable between a protective position in which said retractable needle guard assembly extends at least the length of said hollowed needle and a retracted position in which said retractable needle guard assembly extends a portion of the length of said hollowed needle so as to expose the sharpened tip, said retractable needle guard assembly comprising, (i) a fixedly mounted needle guard which is affixed onto said needle holder over said hollowed needle, and (ii) a movable needle guard which is slidably mounted onto said fixedly mounted needle guard, (d) a feed mechanism for advancing the fastener stock into said hollowed needle, (e) a severing mechanism for severing the fastener to be dispensed through said hollowed needle from the fastener stock, and (f) an ejection mechanism for ejecting the severed fastener through said hollowed needle.

9. The module of claim 8 wherein said fixedly mounted needle guard comprises a base and an elongated sleeve formed onto said base, the elongated sleeve of said fixedly mounted needle guard including a free end and an enlarged flange.

10. The module of claim 9 wherein said movable needle guard comprises a collar and an elongated sleeve, the elongated sleeve of said movable needle guard including a free end and a stop.

11. The module of claim 10 wherein the flange of the fixedly mounted needle guard abuts against the stop of the movable needle guard when said retractable needle guard assembly is disposed in its protective position.

12. The module of claim 11 wherein the collar of the movable needle guard abuts against the base of fixedly mounted needle guard when said retractable needle guard assembly is disposed in its retracted position.

* * * * *